US010156027B2

(12) United States Patent
Wu et al.

(10) Patent No.: US 10,156,027 B2
(45) Date of Patent: Dec. 18, 2018

(54) METHOD OF MANUFACTURING A BUNDLE OF ELECTROSPUN YARN AND MANUFACTURING EQUIPMENT FOR THE SAME

(71) Applicant: National Taiwan University of Science and Technology, Taipei (TW)

(72) Inventors: Chang-Mou Wu, Taipei (TW); Kuo-Pin Cheng, Taipei (TW); Ching-Feng Li, Taipei (TW)

(73) Assignee: National Taiwan University of Science and Technology, Taipei (TW)

( * ) Notice: Subject to any disclaimer, the term of this patent is extended or adjusted under 35 U.S.C. 154(b) by 408 days.

(21) Appl. No.: 14/935,501

(22) Filed: Nov. 9, 2015

(65) Prior Publication Data

US 2016/0130728 A1 May 12, 2016

(30) Foreign Application Priority Data

Nov. 11, 2014 (TW) ..... 103139107 A

(51) Int. Cl.
*D01D 5/00* (2006.01)

(52) U.S. Cl.
CPC ..... *D01D 5/0069* (2013.01); *D01D 5/0061* (2013.01); *D01D 5/0076* (2013.01)

(58) Field of Classification Search
CPC .. D01D 5/0076; D01D 5/0007; D01D 5/0061; D01D 5/0069
See application file for complete search history.

(56) References Cited

U.S. PATENT DOCUMENTS 8,999,285 B2 * 4/2015 Lashmore ..... B82Y 30/00 423/447.1
2009/0162468 A1 * 6/2009 Barinov ..... D01D 5/0092 425/145
2011/0180951 A1 * 7/2011 Teo ..... A61L 27/38 264/109

* cited by examiner

*Primary Examiner* — Robert J Grun
(74) *Attorney, Agent, or Firm* — Alan D. Kamrath; Kamrath IP Lawfirm, P.A.

(57) ABSTRACT

An equipment of manufacturing a bundle of electrospun yarn has a vortex containing device and a bundles collecting device. The vortex containing device has a feeding end, an exporting end and a vortex generator. The vortex generator is mounted in and communicates with the vortex containing device to form a fluid vortex in the vortex containing device to provide a guiding force. The guiding force draws an electrospun fiber into the feeding end of the vortex containing device. The electrospun fiber is wound to form a bundle of electrospun yarn by the fluid vortex. The bundles collecting device is rotated to collect the bundle of electrospun yarn.

9 Claims, 12 Drawing Sheets

METHOD OF MANUFACTURING A BUNDLE OF ELECTROSPUN YARN AND MANUFACTURING EQUIPMENT FOR THE SAME

BACKGROUND OF THE INVENTION

1. Field of the Invention

The present invention relates to a method of manufacturing a bundle of electrospun yarn.

2. Description of Related Art

Electrospun fibers and related fiber webs are serving mostly as carriers of drugs, dispersion media of different additives (nanodots, antimicrobial particles etc) and the like. For certain applications, it is of interest and important to electrospin alternative structures instead of the non-woven mats that are commonly formed from an electrospinning (ES) process. The nanofibers can be applied as filter material, biomedical elements, tissue scaffolds, biosensors, photoelectric components, reinforced composite materials, etc. Nanofibers can be manufactured by a conventional electrospinning method. Nanofibers have a high ratio of surface area to volume and is able to be applied on chemical sensors or biological sensors with a fast response time, good sensitivity and selectivity. Therefore, the electrospinning method is concerned and is rapidly developed.

For certain applications, it is of interest and important to electrospun alternative structures instead of the non-woven mats that are commonly formed from an ES process. Alignment of fibers is important for enabling the twisting of aligned fiber bundles in achieving the ultimate formation of continuous nanofiber and yarns. Several techniques have been developed to control the deposition of the electrospun nanofibers and to obtain continuous alignment by manipulating of the electric field, by changing the static collection geometry and by devising several collection mechanisms.

However, the conventional electrospinning method is limited by the drawbacks of process. Nanofibers are mostly applied to a filtration membrane as a non-woven mesh. Individualizing and assembling these aligned nanofibers and spinning them into a yarn is still an area under investigation in nanofabrication and engineering. Less work is devoted to exploit their inherent structure and properties.

SUMMARY OF THE INVENTION

In order to solve the disadvantages and shortcomings of the conventional nanofiber, the present invention provides a method of manufacturing a bundle of electrospun yarn that provides a preferred strength and that makes producing nanofibers as a woven product possible.

The manufacturing equipment in accordance with the present invention has a vortex containing device and a bundles collecting device. The vortex containing device has a feeding end, an exporting end and a vortex generator. The vortex generator is mounted in and communicates with the vortex containing device to form a fluid vortex in the vortex containing device. The fluid vortex provides a guiding force. The guiding force draws an electrospun fiber into the feeding end of the vortex containing device. The electrospun fiber is wound to form a bundle of electrospun yarn by the fluid vortex. The bundles collecting device is rotated to collect the bundle of electrospun yarn.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
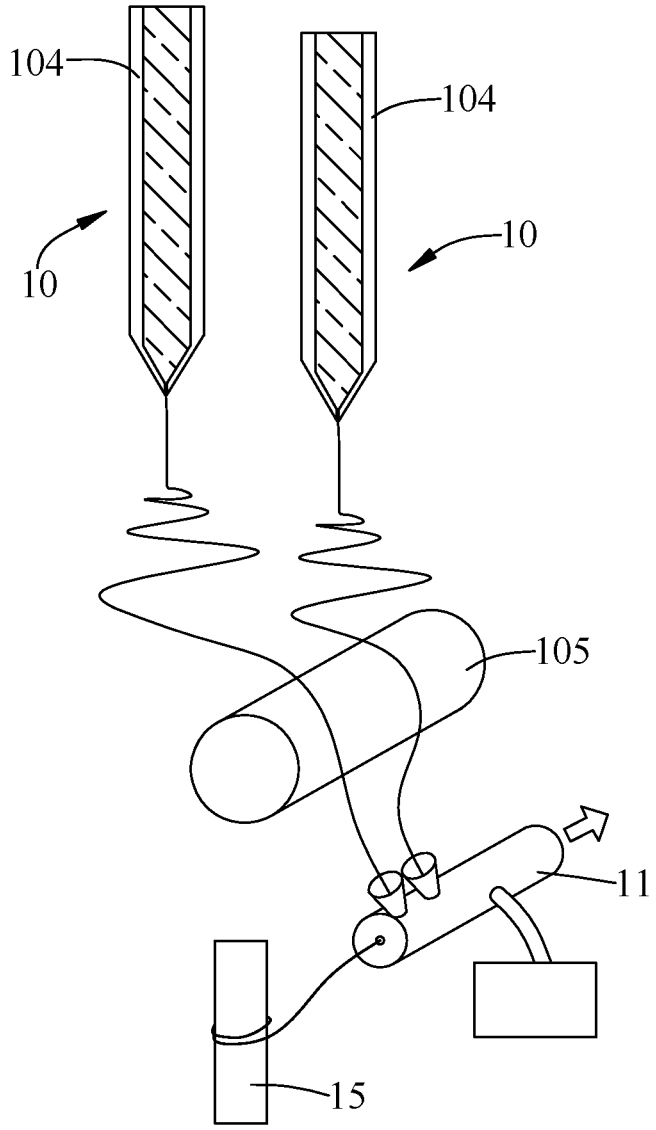
FIG. 1 is a perspective view of manufacturing equipment in accordance with the present invention.

With reference to FIG. 1, manufacturing equipment for manufacturing a bundle of electrospun yarn in accordance with the present invention comprises at least one electrospinning device 10, a vortex containing device 11 and a bundles collecting device 15.

In a preferred embodiment, the at least one electrospinning device 10 may be vertically installed, and each one of the at least one electrospinning device 10 has an extruder, a heater, a gear pump, an injecting head 104, a receiving member 105 and an electrostatic generator. The extruder is a hollow tube and has a bottom end. The extruder is used to store an electrospun liquid/melt. Preferably, the electrospun material may be a solution type electrospun liquid or a melt type electrospun melt. In addition, the electrospun liquid/melt may be modified polyesters (Biomax, DuPont, U.S.A, Tm=198.07° C.), polyvinylidene flouride-co-hexafluoropropylene (PVDF co-HFP, Mw 455,000) or a solution with 40 wt % dimethylacetamide and 60 wt % acetone heated to 60° C.

The heater is communicated to the extruder for heating the electrospun liquid/melt being stored in the extruder. The gear pump is connected to the extruder to provide a feeding force to push the electrospun liquid/melt out of the extruder. The injecting head 104 is connected to the bottom end of the extruder. Then, the electrospun liquid/melt in the extruder is pushed out of the extruder to form electrospun fibers. In the preferred embodiment, the receiving member 105 is mounted below the injecting head 104 to receive the electrospun fiber.

The electrostatic generator is electrically connected to the receiving member. Preferably, the electrostatic generator is a positive voltage type electrostatic generator (Apollo-P60, Taiwell, Taiwan) and is used to provide an electrostatic field to the receiving member 105. A direction of the electrostatic field can be controlled by the electrostatic generator and a ground wire that are connected to two ends of the receiving member 105. The strength of the electrostatic field may be, but is not limited to, 80 KV, a distance between the injecting head 104 and the receiving member 105 is 4 centimeters, and a feed rate of the gear pump is 0.01 μL/min.

The vortex containing device 11 is mounted below the electrospinning 10 and is used to contain a fluid vortex. Preferably, the vortex containing device 11 maybe a hollow tube with a feeding end and an exporting end. The vortex containing device 11 may be, but is not limited to, a glass tube or an acrylic tube. In addition, the vortex containing device 11 may be a tank with a feeding end and an exporting end. When the electrospun fiber is drawn into the vortex containing device 11, the electrospun fiber may be rotated or collected by the fluid vortex to form a bundle of electrospun yarn.

Furthermore, the vortex containing device 11 is connected to a vortex generator. The vortex generator is able to generate a fluid vortex as a guiding force by sucking or blowing fluids contained in the vortex containing device 11. The fluid vortex is able to create a pressure difference between the vortex containing device and outside environment causing the electrospun fiber to be drawn into the vortex containing device. The fluid vortex may be a gas vortex or a liquid vortex. The preferred pressure difference between the vortex containing device and the outside environment is 30 L/min-100 L/min.

Preferably, the yarn is formed by a gas vortex in the hollow tube. Air is sucked by a vacuum source into the tube through hole. The vacuum source may be the vortex generator. This incoming air moves upward along a tube wall of the tube in a spiral and finally arrives at a tube seal. The end of the tube is closed by the seal. The air then flows to a center of the tube and moves back again to the vacuum source. Thus, the air vortex, rotating continuously in the same direction, is generated at the seal. The electrospun fibers were allowed to enter through a tangential opening inlet, which is the feeding end. The air stream grasps these fibers and transports it toward and into the vortex. To form a yarn, a guiding yarn end may be passed into the tube through a passage in the tube seal. The vortex grasps this yarn end and whirls it around in circles in the same way as the fibers.

The liquid vortex is able to provide a fluid suction force to suck the electrospun fiber into the vortex containing device 11 via the feeding end of the vortex containing device 11 to form the bundle of electrospun yarn. In addition, the liquid vortex can be formed by forming an outlet hole on the vortex containing device 11 and the continuous injecting liquid in the vortex containing device 11.

In a first embodiment of the vortex containing device 11, the vortex containing device 11 is a hollow tube with a feeding end, an exporting end and an air hole. The electrospun fiber E is drawn into the hollow tube of the vortex containing device 11 via the feeding end. The gas that is stored in the hollow tube may be compressed to form a convergent-divergent channel hollow tube via the air hole by the vortex generator. The compressed gas will form two vortexes with opposite rotating directions along with an axial direction in the hollow tube. Thus, the bundle of the electrospun yarn may be formed by the vortexes with opposite rotating directions in the vortex containing device 11.

In a second embodiment of the vortex containing device 11, the vortex containing device 11 is a hollow tube with multiple feeding ends, an exporting end and an air hole. The electrospun fibers are respectively drawn into the hollow tube via multiple electrospinning devices 10. The gas that is stored in the hollow tube may be compressed to form a convergent-divergent channel via the air hole by the vortex hollow tube. The compressed air will form two vortexes with opposite rotating directions along with an axial direction in the hollow tube. Thus, the bundle of the electrospun yarn may be formed by the vortexes with opposite rotating directions in the vortex containing device 11.

In a third embodiment of the vortex containing device 11, the vortex containing device 11 may be a tank with a feeding end and an exporting end. The tank contains a liquid vortex generated by the vortex generator. The electrospun fiber is drawn into the tank by the liquid vortex via the feeding end. Thus, the bundle of the electrospun yarn may be formed by the liquid vortex.

In a fourth embodiment of the vortex containing device 11, the vortex containing device 11 is a tank with multiple feeding ends and an exporting end. The electrospun fibers are respectively drawn into the feeding ends of the tank via multiple electrospinning devices 10. The tank contains a liquid vortex generated by the vortex generator. Thus, the bundle of the electrospun yarn may be formed by the liquid vortex.

Furthermore, when the electrospun fibers are drawn into the vortex containing device 11, a guiding element may be introduced to attach the initial electrospun fiber to continuously bundle the electrospun fiber more easily. After manufacturing the bundle of electrospun yarn, the bundle of electrospun yarn may be moved out of the exporting end of the vortex containing device 11 by pulling the guiding element. Preferably, the guiding element can be small pieces of the bundle of electrospun yarn.

The electrospun fibers may be formed by a solvent type and a melt type of the electrospun processes. Differences of the production rate of the two processes in the present invention are listed in the Table 1.

TABLE 1

| | melt type | solution type |
|---|---|---|
| Feed rate | 54 mg/min | 0.93 mg/min |
| Diameter of the electrospun fiber | 10 μm | 200 nm |

The electrospun fibers are drawn into the vortex containing device 11 to form the bundle of electrospun yarn. The production rate of the bundle of electrospun yarn is between 0.5 mg/min to 60 mg/min. According to the Table 1, the yield of the bundle of electrospun yarn being formed by the melt type electrospun melt is higher than the yield of the bundle of electrospun yarn being formed by the solution type electrospun liquid. In the present invention, the production rate of the bundle of electrospun yarn may also be increased by using multiple spinning nuzzles or adjusting the feed rate of the gear pump.

Figure 2:
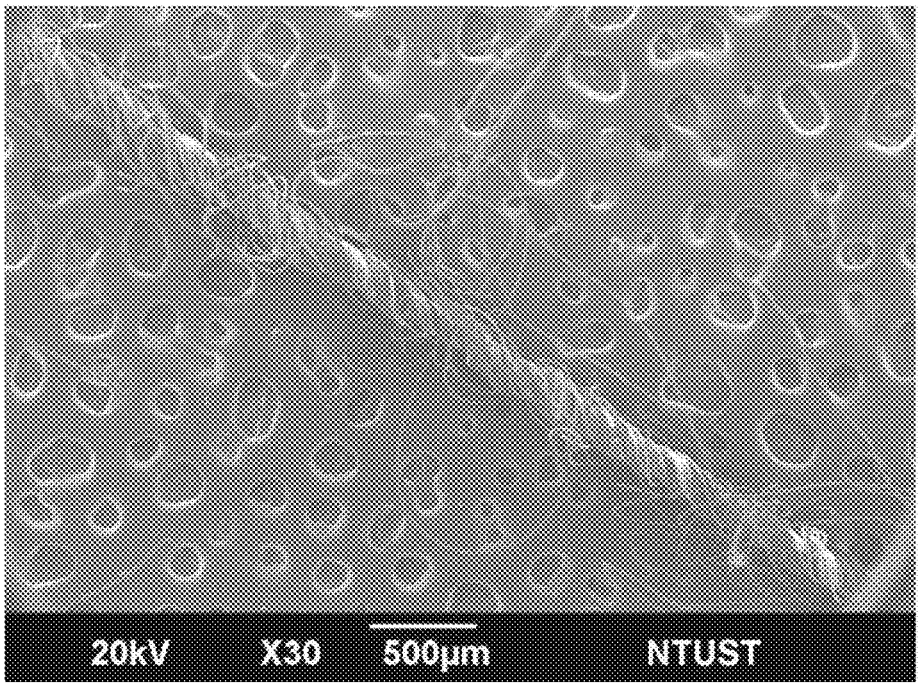
FIG. 2 is an enlarged top view of a bundle of electrospun yarn in accordance with the present invention by a three-dimensional optical microscopy with a winding speed of 220 cm/min.
Figure 3:
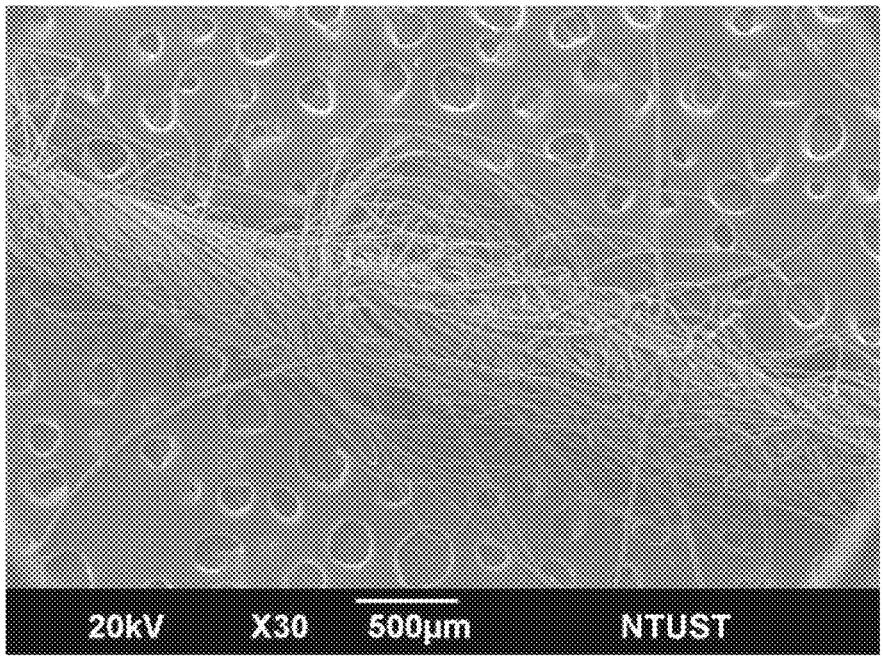
FIG. 3 is an enlarged top view of a bundle of electrospun yarn in accordance with the present invention by a three-dimensional optical microscopy with a winding speed of 140 cm/min.
Figure 4:
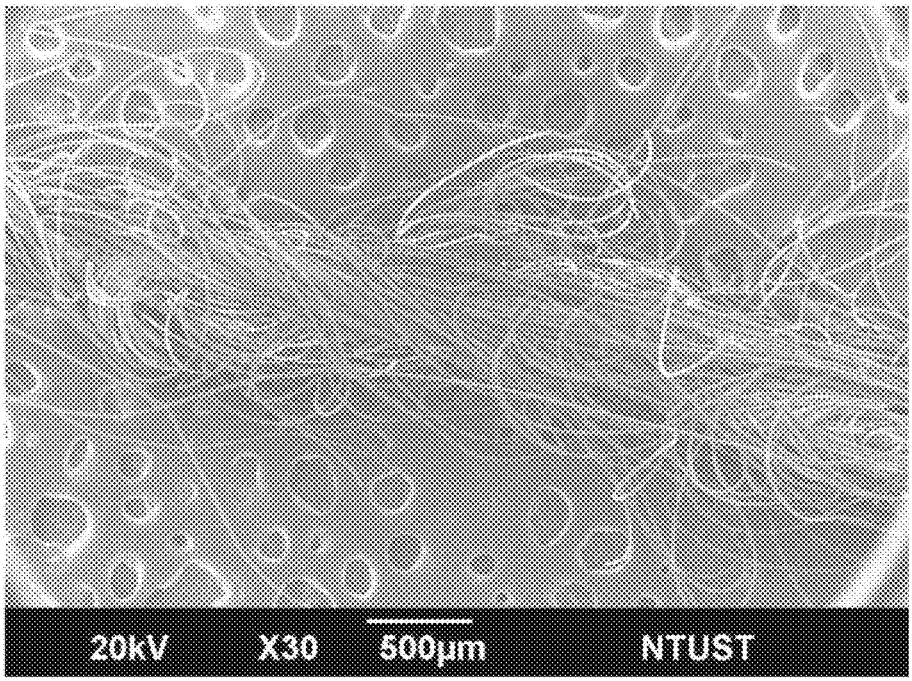
FIG. 4 is an enlarged top view of a bundle of electrospun yarn in accordance with the present invention by a three-dimensional optical microscopy with a winding speed of 60 cm/min.

The bundles collecting device 15 is rotatably mounted on a side of the vortex containing device 11 and is rotated to collect the bundle of electrospun yarn. The winding speed of the bundles collecting device 15 depends on the machine size, the force of the vortex, etc. In the present embodiments, the winding speed of the bundles collecting device 15 is between 20 cm/min-300 cm/min to provide a preferred twisting effect. In addition, the bundles collecting device 15 has a deceleration device to control the winding speed of the bundles collecting device 15, and this may also adjust the diameter of the bundle of electrospun yarn. With reference to FIGS. 2 to 4 and Table 2, under a same gas/hydraulic pressure, the diameters of the bundle of electrospun yarn correspond to the winding speed of the bundles collecting device 15.

In the air vortex example, an outer yarn of the guiding yarn is held by the withdrawal roller, i.e. the bundles collecting device 15, and with the inner end rotating, each revolution of the yarn end in the vortex inserts a turn of twist into the yarn.

In a first embodiment of the method of manufacturing a bundle of electrospun yarn in accordance with the present invention comprises:

heating the electrospinning device 10 at a specific temperature (the specific temperature is between 200° C. to 205° C.);

introducing the electrospun liquid/melt into the electrospinning device 10;

pushing the electrospun liquid/melt out of the injecting head 104 via the extruder that is driven by a servo motor;

controlling the feed rate of the electrospun liquid/melt by the gear pump;

forming an electrospun fiber to move along the direction of the electrostatic field toward the receiving member 105;

drawing the electrospun fiber into the vortex containing device 11 to form a bundle of electrospun yarn; and collecting the bundle of electrospun yarn by the bundles collecting device 15 to collect the bundle of electrospun yarn.

In a second embodiment of the method of manufacturing a bundle of electrospun yarn in accordance with the present invention comprises:

heating the electrospinning device 10 at a specific temperature (the specific temperature is between 200° C. to 205° C.);

putting the electrospun liquid/melt into the electrospinning device 10;

introducing the electrospun liquid/melt to the injecting head 104 by gravity;

controlling the feed rate of the electrospun liquid/melt by the gear pump forming an electrospun fiber to move along the direction of the electrostatic filed toward the receiving member 105;

drawing the electrospun fiber into the vortex containing device 11 to form a bundle of electrospun yarn; and collecting the bundle of electrospun yarn by the bundles collecting device 15 to collect the bundle of electrospun yarn.

TABLE 2

| | | | | | | | | |
|---|---|---|---|---|---|---|---|---|
| Winding speed (cm/min) | | | 220 | | | 140 | | 60 |
| Diameter of the bundle of electrospun yarn (μm) | | | 154 | | | 651 | | 824 |
| Twisting angle | | | 48 | | | 67 | | 81 |
| Residual charge (kV) | | | | | | | | |
| $1^{st}$ day | $4^{th}$ day | $7^{th}$ day | $1^{st}$ day | $4^{th}$ day | $7^{th}$ day | $1^{st}$ day | $4^{th}$ day | $7^{th}$ day |
| 3.37 ± 0.48 | 2.36 ± 0.36 | 0.18 ± 0.005 | 2.12 ± 0.15 | 1.36 ± 0.35 | 0.51 ± 0.16 | 1.03 ± 0.14 | 0.62 ± 0.47 | 0.54 ± 0.21 |

Figure 5:
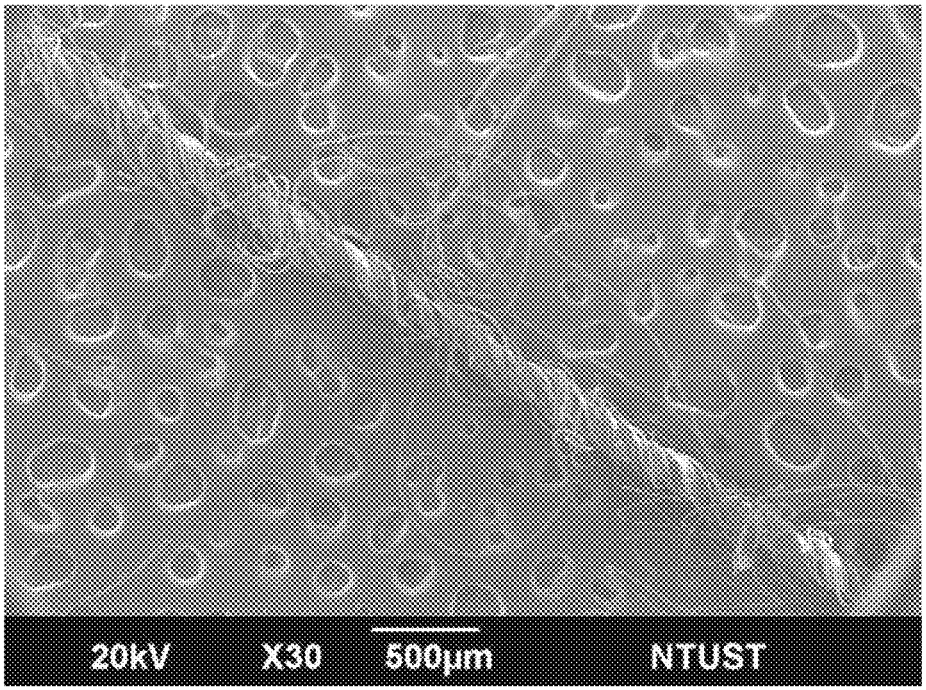
FIG. 5 is an enlarged top view of a bundle of electrospun yarn in accordance with the present invention by a three-dimensional optical microscopy with a pressure of 100 L/min.
Figure 6:
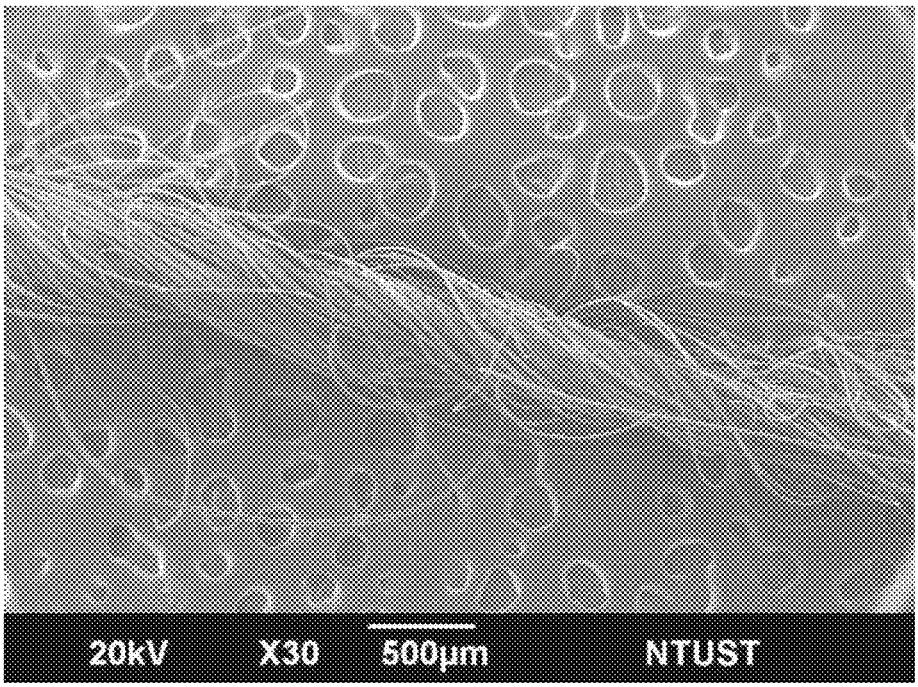
FIG. 6 is an enlarged top view of a bundle of electrospun yarn in accordance with the present invention by a three-dimensional optical microscopy with a pressure of 70 L/min.
Figure 7:
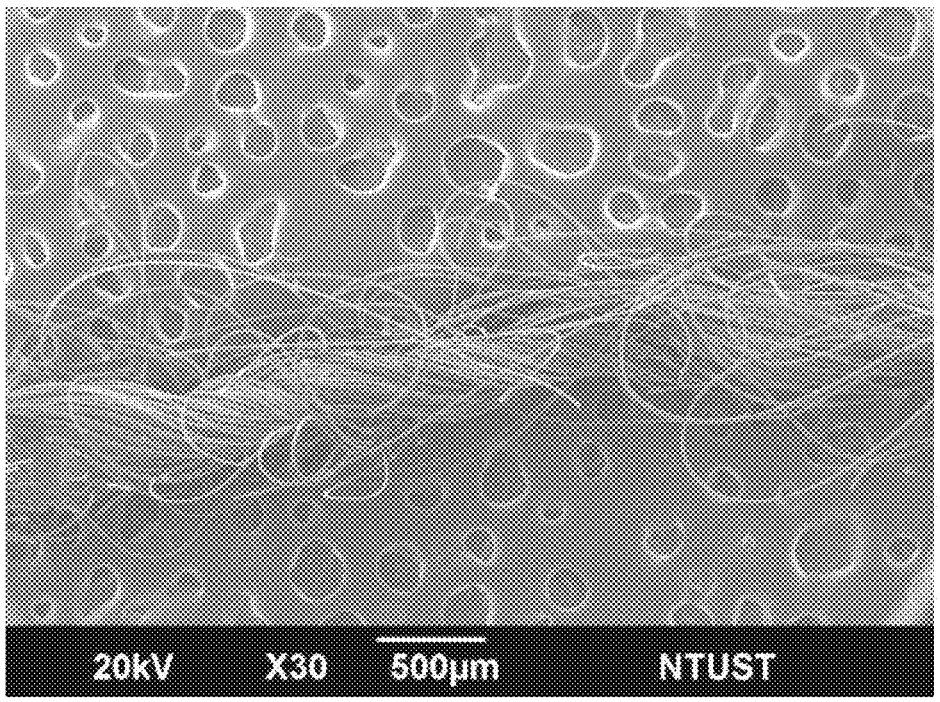
FIG. 7 is an enlarged top view of a bundle of electrospun yarn in accordance with the present invention by a three-dimensional optical microscopy with a pressure of 40 L/min.
Figure 8:
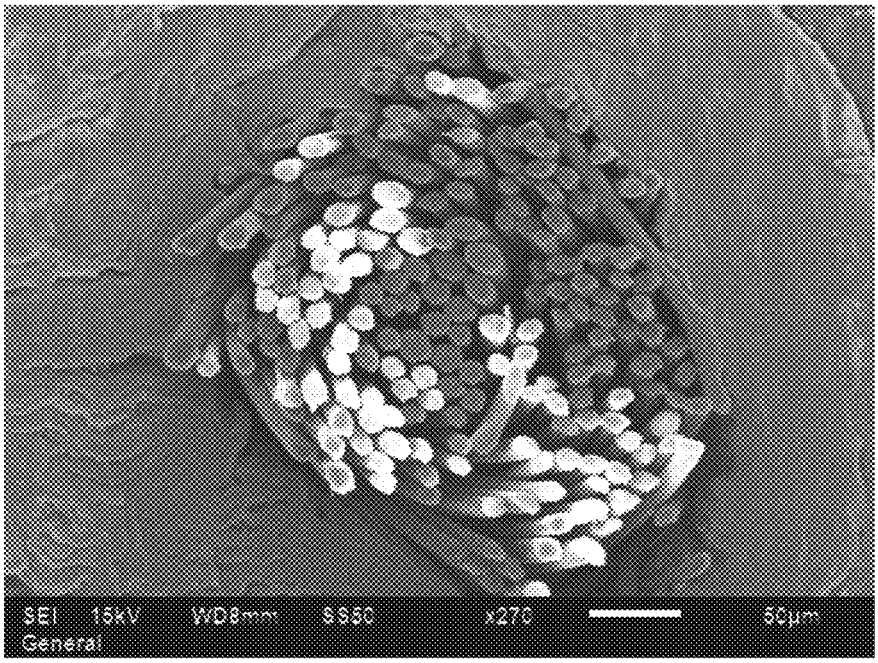
FIG. 8 is an enlarged cross sectional side view of a bundle of electrospun yarn in accordance with the present invention by a scanning electron microscope with a pressure of 100 L/min.
Figure 9:
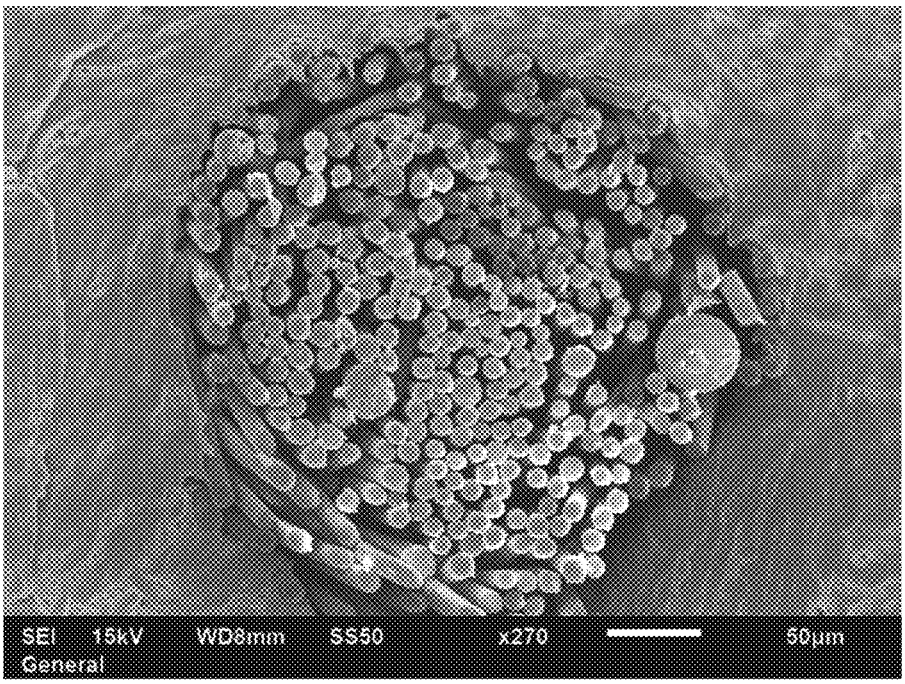
FIG. 9 is an enlarged cross sectional side view of a bundle of electrospun yarn in accordance with the present invention by a scanning electron microscope with a pressure of 70 L/min.
Figure 10:
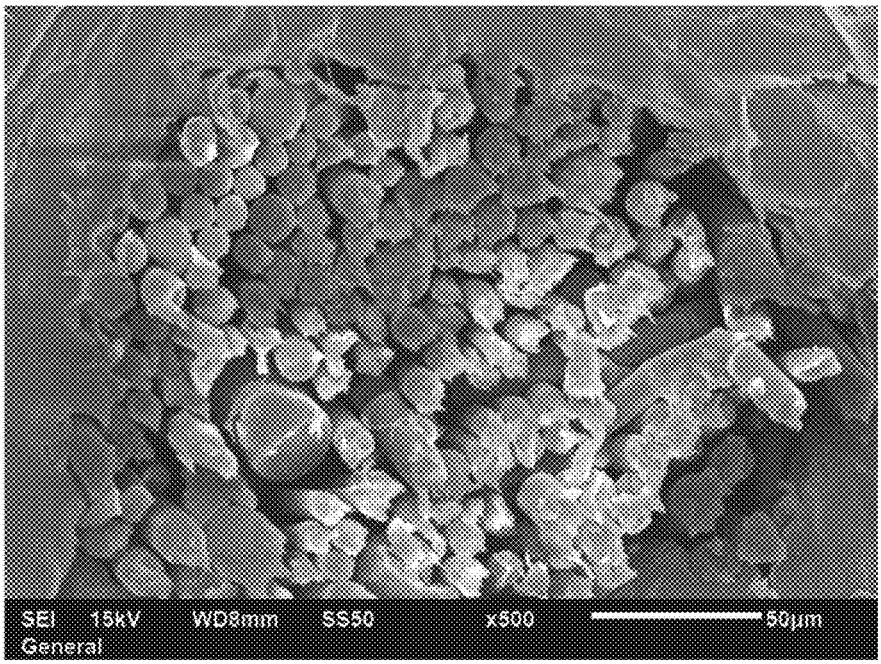
FIG. 10 is an enlarged cross sectional side view of a bundle of electrospun yarn in accordance with the present invention by a scanning electron microscope with a pressure of 40 L/min.
Figure 11:
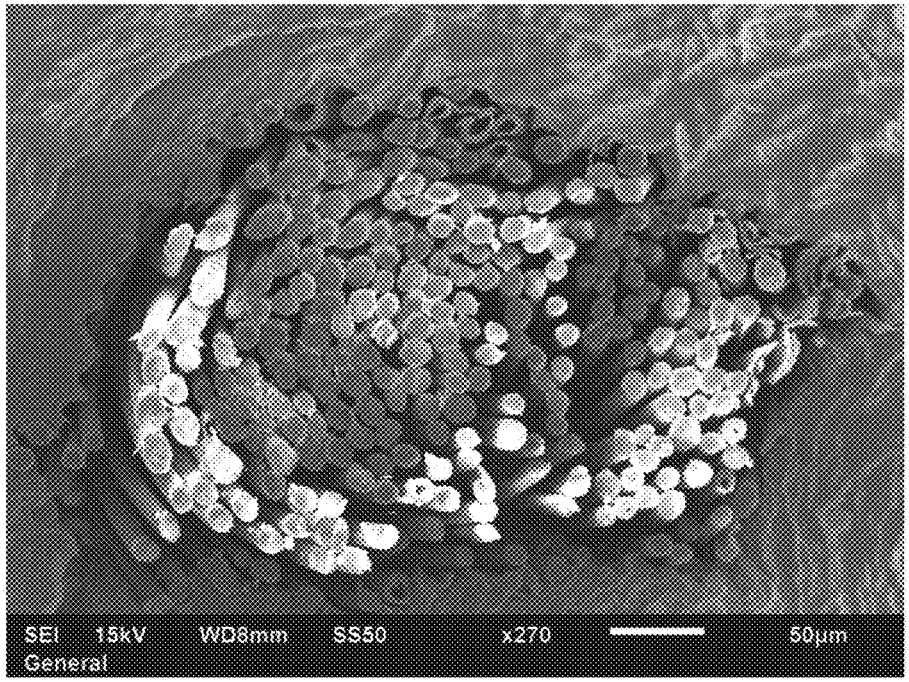
FIG. 11 is an enlarged cross sectional side view of a bundle of electrospun yarn in accordance with the present invention by a scanning electron microscope with a winding speed of 60 cm/min.
Figure 12:
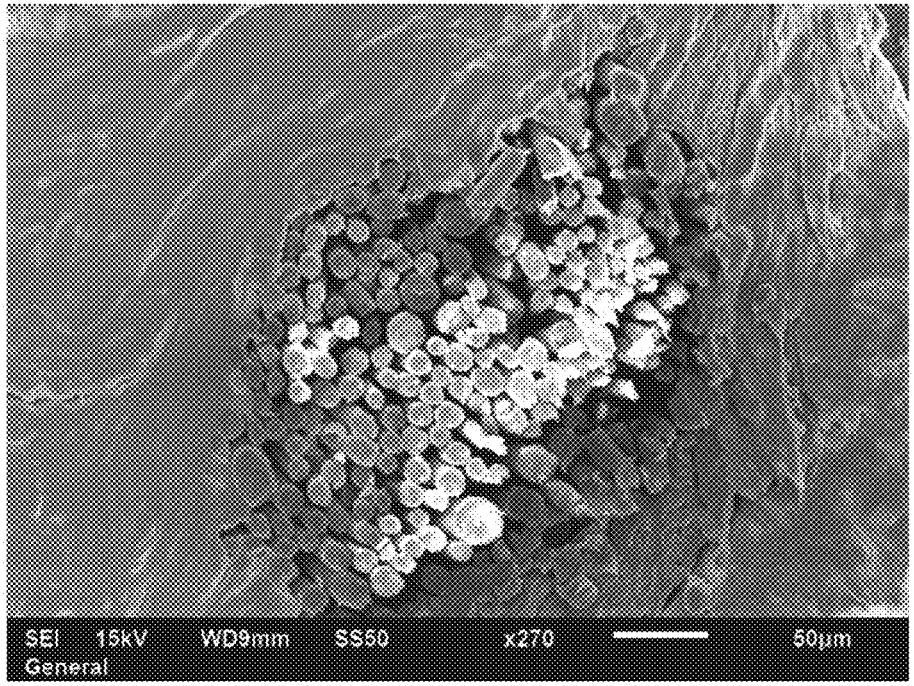
FIG. 12 is an enlarged cross sectional side view of a bundle of electrospun yarn in accordance with the present invention by a scanning electron microscope with a winding speed of 140 cm/min.

With reference to FIGS. 5 to 7 and Table 3, under a same winding speed of the bundles collecting device 15, the diameters of the bundle of electrospun yarn correspond to the gas/hydraulic pressure.

TABLE 3

| | | | | | | | | |
|---|---|---|---|---|---|---|---|---|
| Gas/hydraulic pressure (L/min) | | | 100 | | | 70 | | 40 |
| Diameter of the bundle of electrospun yarn (μm) | | | 154 | | | 532 | | 653 |
| Twisting angle | | | 48 | | | 66 | | 77 |
| Residual charge (kV) | | | | | | | | |
| $1^{st}$ day | $4^{th}$ day | $7^{th}$ day | $1^{st}$ day | $4^{th}$ day | $7^{th}$ day | $1^{st}$ day | $4^{th}$ day | $7^{th}$ day |
| 3.37 ± 0.48 | 2.36 ± 0.36 | 0.18 ± 0.004 | 1.36 ± 0.12 | 1.33 ± 0.48 | 0.95 ± 0.21 | 0.62 ± 0.31 | 0.49 ± 0.47 | 0.41 ± 0.08 |

According to the date disclosed in Table 2 and Table 3, the bundle of electrospun yarn in the seventh day still has the residual charge, and this means the bundle of electrospun yarn can provide a direct electret effect. Then, the bundle of electrospun yarn can be used as non-woven without an electret process and can provide a preferred filtering effect.

In the present invention, a macroscopic structure of the bundle of electrospun yarn can be observed by using a monocular digital camera (Cannon EOS 70D, Japan), a microscopic structure of the bundle of electrospun yarn can be observed by using a three-dimensional optical microscopy (10× magnification eyepiece, 40× magnification lens) and the twisting angle and structure of the electrospun fiber can be observed by using a scanning electron microscope (SEM, HITACHI S3000H, Japan).

With reference to FIGS. 8 to 12, the bundle of electrospun yarn is formed from the melt type electrospun melt and may have a hollow structure that is caused by the shapes of the exporting end of the vortex containing device 11. Then, the bundle of electrospun yarn can have different cross-sections by using different shapes of the exporting end of the vortex containing device 11, and the cross-section of the bundle of electrospun yarn can be cross-shaped, elliptical, double layers or hollow to enable the bundle of electrospun yarn to be woven as functional fabrics.

The method of manufacturing a bundle of electrospun yarn and the manufacturing equipment in accordance with the present invention as described has the following advantages.

1. The present invention provides an innovative method and apparatus to collect fibers as yarns. The present invention may use the melt type electrospun melt to form the bundle of electrospun yarn. In the manufacturing process, the bundle of electrospun yarn can be manufactured without using solvents to reduce pollution to the environment.

2. Different cross-sections of the bundle of electrospun yarns can be manufactured according to the user's need by using different shapes of the exporting end of the vortex containing device 11. Then, the user can use the cross-shaped, elliptical, double layers or hollow cross-section of the bundle of electrospun yarns to be woven as functional fabrics.

3. After the manufacturing process of the present invention, the bundle of electrospun yarn can provide a direct electret effect. Then, the bundle of electrospun yarn can be used as non-woven without an electret process and can provide a preferred filtering effect.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. Manufacturing equipment comprising a vortex containing device, a bundles collecting device and multiple electrospinning devices, wherein:

the vortex containing device has multiple feeding ends, an exporting end and a vortex generator;

the multiple electrospinning devices respectively align with the multiple feedings ends of the vortex containing device;

a controller programmed to control each electrospinning device to have a different feed rate to produce different diameters of electrospun fiber;

the vortex generator is mounted in and communicates with the vortex containing device to form a fluid vortex in the vortex containing device to provide a guiding force to the vortex containing device;

the guiding force leads the electrospun fiber continuously into the vortex containing device to form a bundle of electrospun yarn;

the vortex containing device is a hollow tube having an air hole;

the multiple feeding ends of the vortex containing device are deposited at a lateral side of the hollow tube;

the air hole of the vortex containing device is mounted on the lateral side of the hollow tube;

the multiple feeding ends are deposited closer to the exporting end than the vortex generator;

the fluid vortex is a gas vortex and is formed in the vortex containing device by the vortex generator sucking or blowing to the vortex containing device via the air hole to form the guiding force with a pressure difference between 30 L/min to 100 L/min to form the bundle of electrospun yarn with different diameters; and the bundles collecting device is rotatably connected to the vortex containing device to collect the bundle of electronspun yarn that is drawn out of the exporting end of the vortex containing device.

2. The manufacturing equipment as claimed in claim 1, wherein a winding speed of the bundles collecting device is between 20 cm/min ~300 cm/min to provide different diameters of the bundle of electrospun yarn.

3. The manufacturing equipment as claimed in claim 1, wherein each electrospinning device has:

a bottom end; and an electrospun liquid/melt stored in the electrospinning device, flowed out of the electrospinning device via the bottom end of the electrospinning device to form the electrospun fiber and lead into the vortex containing device with a feed rate between 0.5 mg/min to 60 mg/min to form the bundle of electrospun yarn with different diameters.

4. The manufacturing equipment as claimed in claim 2, wherein a winding speed of the bundles collecting device is between 20 cm/min ~300 cm/min to provide different diameters of the bundle of electrospun yarn.

5. Manufacturing equipment comprising a vortex containing device, a bundles collecting device and multiple electrospinning devices, wherein:

the vortex containing device has multiple feeding ends, an exporting end and a vortex generator;

the multiple electrospinning devices respectively align with the multiple feedings ends of the vortex containing device;

a controller programmed to control each electrospinning device to have a different feed rate to produce different diameters of electrospun fiber;

the vortex generator is mounted in and communicates with the vortex containing device to form a fluid vortex in the vortex containing device to provide a guiding force to the vortex containing device;

the guiding force leads the electrospun fiber continuously into the vortex containing device to form a bundle of electrospun yam;

the vortex containing device is a tank with liquid and the liquid vortex is formed from the liquid to provide the guiding force; and the bundles collecting device is rotatably connected to the vortex containing device to collect the bundle of electronspun yarn that is drawn out of the exporting end of the vortex containing device.

6. The manufacturing equipment as claimed in claim 5, wherein each electrospinning device has:

a bottom end; and an electrospun liquid/melt stored in the electrospinning device, flowed out of the electrospinning device via the bottom end of the electrospinning device to form the electrospun fiber and lead into the vortex containing device with a feed rate between 0.5 mg/min to 60 mg/min to form the bundle of electrospun yarn with different diameters.

7. A method of manufacturing a bundle of electrospun yarn comprising:

preparing multiple electrospun fibers from multiple electrospinning devices using a controller programmed to control the multiple electrospinning devices to have different feed rates to produce electrospun fibers having different diameters;

aligning said multiple electrospinning devices with a vortex containing device having multiple feed ends, an exporting end and a vortex generator; wherein:

the vortex generator is mounted in and communicates with the vortex containing device to form a fluid vortex in the vortex containing device to provide a guiding force to the vortex containing device;

the guiding force leads the electrospun fiber continuously into the vortex containing device to form a bundle of electrospun yarn;

the vortex containing device is a hollow tube having an air hole;

the multiple feeding ends of the vortex containing device are deposited at a lateral side of the hollow tube;

the air hole of the vortex containing device is mounted on the lateral side of the hollow tube; and the multiple feeding ends are deposited closer to the exporting end than the vortex generator; and collecting the bundles using a bundles collecting device which is rotatably connected to the vortex containing device to collect the bundle of electrospun yarn that is drawn out of the exporting end of the vortex containing device.

8. The method of manufacturing a bundle of electrospun yarn as claimed in claim 7, wherein the fluid vortex is a gas vortex.

9. The method of manufacturing a bundle of electrospun yarn as claimed in claim 7, wherein the fluid vortex is a liquid vortex.

* * * * *